US008344658B2

(12) United States Patent
Ribarich et al.

(10) Patent No.: US 8,344,658 B2
(45) Date of Patent: Jan. 1, 2013

(54) COLD-CATHODE FLUORESCENT LAMP MULTIPLE LAMP CURRENT MATCHING CIRCUIT

(75) Inventors: Thomas J. Ribarich, Laguna Beach, CA (US); Edgar Abdoulin, Woodland Hills, CA (US)

(73) Assignee: International Rectifier Corporation, El Segundo, CA (US)

( * ) Notice: Subject to any disclaimer, the term of this patent is extended or adjusted under 35 U.S.C. 154(b) by 929 days.

(21) Appl. No.: 11/624,298

(22) Filed: Jan. 18, 2007

(65) Prior Publication Data

US 2007/0164686 A1 Jul. 19, 2007

Related U.S. Application Data

(60) Provisional application No. 60/760,108, filed on Jan. 19, 2006.

(51) Int. Cl.
*H05B 37/02* (2006.01)

(52) U.S. Cl. ..... 315/307; 315/291; 315/308

(58) Field of Classification Search ..... 315/172, 315/173, 209 R, 225, 245–247, 291, 307, 315/312, 315, 362
See application file for complete search history.

(56) References Cited

U.S. PATENT DOCUMENTS

| | | | | |
|---|---|---|---|---|
| 6,313,588 | B1 * | 11/2001 | Mosebrook et al. | 315/291 |
| 6,420,839 | B1 * | 7/2002 | Chiang et al. | 315/291 |
| 6,667,585 | B2 * | 12/2003 | O'Meara | 315/291 |
| 6,922,023 | B2 | 7/2005 | Hsu et al. | |
| 6,930,898 | B2 | 8/2005 | Jeon et al. | |
| 6,947,024 | B2 | 9/2005 | Lee et al. | |
| 6,954,364 | B2 | 10/2005 | Min | |
| 6,958,919 | B1 | 10/2005 | Kung | |
| 7,119,495 | B2 * | 10/2006 | Jang | 315/244 |
| 7,227,316 | B2 * | 6/2007 | Lu | 315/308 |
| 7,339,327 | B2 * | 3/2008 | O'Gorman et al. | 315/244 |
| 2005/0093472 | A1 | 5/2005 | Jin | |

FOREIGN PATENT DOCUMENTS

| | | | |
|---|---|---|---|
| JP | 2002-043088 | | 2/2002 |
| JP | 2002352974 | A * | 12/2002 |

OTHER PUBLICATIONS

Kim, et al., "Driving cold cathode fluorescent lamps in parallel", *Electronics Letters*, vol. 41, No. 4, Feb. 17, 2005.

Korean Office Action issued Mar. 13, 2008 in connection with corresponding Korean Application No. 6305/2007 with English Language Translation.

* cited by examiner

*Primary Examiner* — Jimmy Vu
(74) *Attorney, Agent, or Firm* — Farjami & Farjami LLP

(57) ABSTRACT

A method and circuit are provided for matching the brightness of a plurality of lamps driven by an AC drive current. The method may comprise the steps of: determining a brightness of each of said plurality of lamps, while said plurality of lamps are on, by using a current sensing device; selecting a first lamp having a lowest brightness from said plurality of lamps; and reducing a brightness of a second lamp to match said lowest brightness of the first lamp by interrupting the AC drive current in said scond lamp periodically for a predetermined number of half-cycles of said AC drive current. According to another implementation, a reference brightness maybe selected, or optionally a reference AC current level, and the method may reduce the drive current periodically so as to set the lamp brightness in relation to the reference brightness or optionally the reference AC current level.

24 Claims, 10 Drawing Sheets

NEW PULSE SKIPPING CURRENT MATCHING CIRCUIT

PULSE SKIPPING CIRCUIT LAMP CURRENT WAVEFORMS

TYPICAL COLD-CATHODE FLUORESCENT LAMP CIRCUIT FOR MULTIPLE LAMPS

KNOWN BALANCE TRANSFORMER CURRENT MATCHING CIRCUIT

NEW PULSE SKIPPING CURRENT MATCHING CIRCUIT

PULSE SKIPPING CIRCUIT LAMP CURRENT WAVEFORMS

PULSE SKIPPING WAVEFORM

TIMING DIAGRAM FOR BASIC CCFL CURRENT BALANCING CIRCUIT

COLD-CATHODE FLUORESCENT LAMP MULTIPLE LAMP CURRENT MATCHING CIRCUIT

CROSS-REFERENCE TO RELATED APPLICATIONS

This application is based upon and claims priority of U.S. Provisional Ser. No. 60/760,108 filed Jan. 19, 2006, by Thomas J. Ribarich and Edgar Abdoulin, titled COLD-CATHODE FLUORESCENT LAMP MULTIPLE LAMP CURRENT MATCHING CIRCUIT, incorporated by reference.

BACKGROUND OF THE INVENTION

1. Field of the Invention

The invention relates to a cold-cathode fluorescent lamp control circuit, and more particularly to a circuit for matching the current in multiple cold-cathode fluorescent lamps, especially for backlighting applications.

2. Related Art

The flat panel LCD market is rapidly growing, as consumers worldwide are adopting LCD televisions and other LCD devices. Manufacturers of LCD televisions are continuously increasing the screen size of these products. An LCD TV requires backlighting, which is typically achieved using several cold-cathode fluorescent lamps that are mounted inside the chassis directly behind the LCD display. The larger the screen size, the greater the number of lamps required.

A major problem with this method is that brightness gradients can appear across the screen due to uneven brightness levels in the respective lamps. FIG. 1 shows a typical CCFL circuit, including a conventional control circuit 100 such as the IR-2153 half-bridge driver, manufactured by the International Rectifier Corp. which controls the fluorescent lamp circuit at a given frequency.

As seen in FIG. 2, with the circuit of FIG. 1, when the resistances of the lamps are not equal, uneven current can flow in the respective lamps, causing uneven brightness levels in the various lamps. Standard CCFL lamps are not matched for voltage or current, and can vary due to normal manufacturing tolerances. Because these lamps typically have a very large resistance (>100K Ohms) and small current (<5 mA), any small difference in voltage, current, or equivalent resistance results in a large difference in brightness. This brightness difference is very noticeable, especially with larger screens when more lamps are used, and causes an uneven light gradient behind the LCD panel.

It is therefore desired to provide a solution that will provide the lamps with both constant and equal brightness levels for a uniform backlighting of the entire LCD screen.

One known solution is a transformer balancing circuit (FIG. 3) which uses transformers to maintain equal current flowing through the respective lamps. Another transformer balancing circuit of background interest is disclosed in U.S. patent application Publication No. 2005/0093472. These circuits are useful, but expensive and bulky due to the large number of balancing transformers needed, especially for larger LCD screens. A typical 16 lamp backlight configuration will need 16 transformers.

According to one embodiment of the invention, a method of matching the brightness of a plurality of lamps driven by an AC drive current may comprise the steps of: selecting a first one of said lamps having a lowest brightness; and reducing the AC drive current in a second lamp periodically so as to reduce the brightness of the second lamp to match that of the first lamp. According to another embodiment, a reference brightness may be selected, or optionally a reference AC current level, and the method may reduce the drive current periodically so as to set the lamp brightness in relation to the reference brightness or optionally the reference AC current level.

A circuit for driving a lamp with controllable brightness may comprise: a drive circuit for supplying an AC drive current to the lamp; and a reducing circuit for reducing the AC drive current in the lamp periodically so as to set the AC drive current in the lamp to match a reference. The reference may correspond to the brightness of another lamp driven by the AC drive circuit, or to a reference AC current level.

The reducing circuit may comprise a switch in series with the lamp, or a parallel connection of a resistance and a switching device connecting the lamp to ground. The AC drive current may be reduced by a predetermined number of half-cycles, preferably by one half-cycle, of said AC drive current. The AC drive current may be reduced by supplying periodic OFF pulses to the reducing circuit, which may be spaced apart by a selected number of half-cycles of the AC drive current, for example by a frequency-dividing circuit which receives and divides the frequency of the AC drive current.

Using an IC to perform the balancing results in a great improvement. Since the lamp currents are very low, the power consumption using an integrated circuit will be low.

Other features and advantages of the invention will be understood from the following description of an embodiment thereof, with reference to the drawings.

DETAILED DESCRIPTION OF EMBODIMENTS OF THE INVENTION

According to an embodiment of the invention (FIG. 4), a pulse skipping current matching control circuit 200 performs active pulse skipping lamp-by-lamp to keep the resulting RMS currents in the lamps (FIG. 5) equal to each other.

Figure 6:
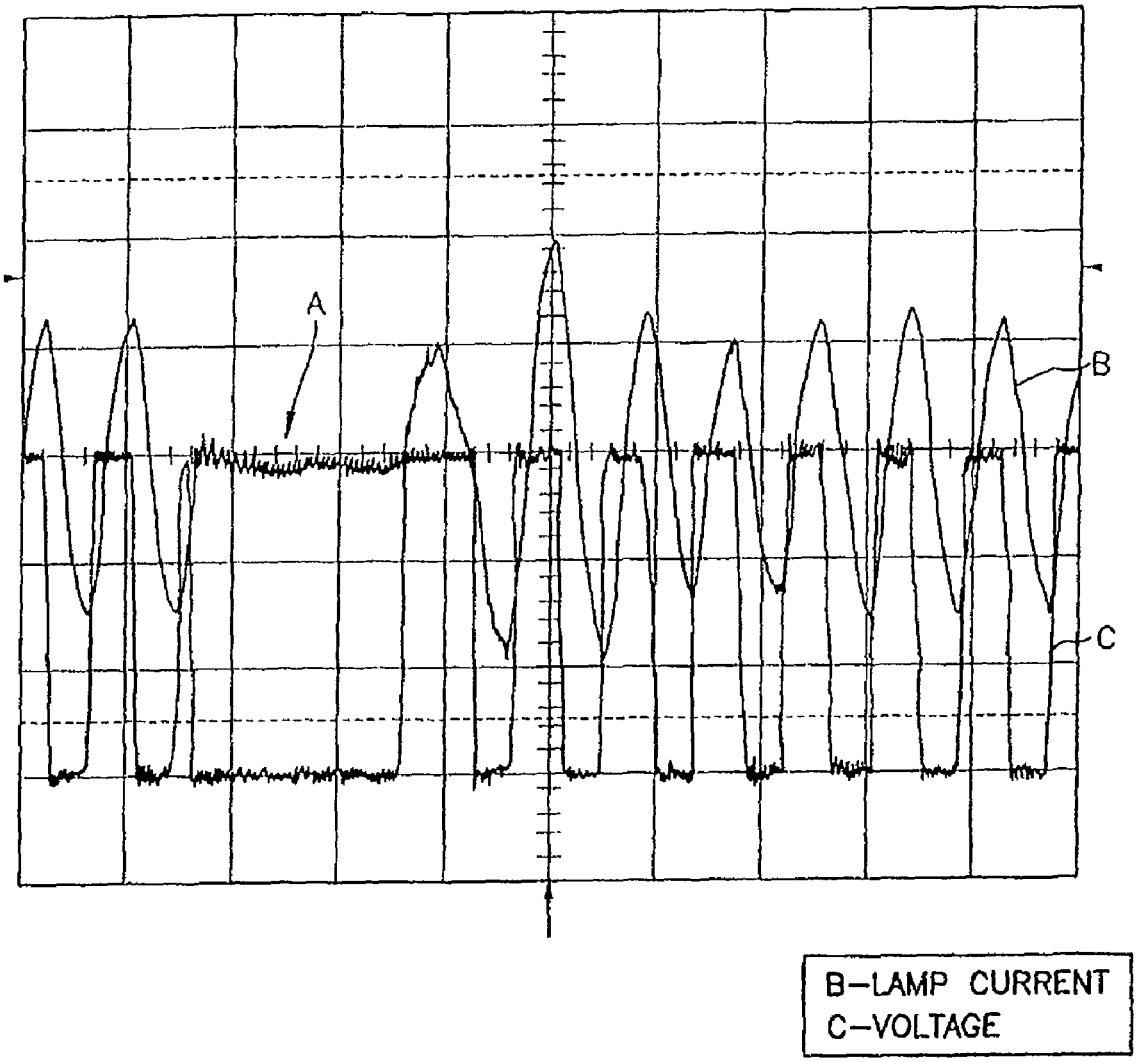
FIG. 6 is a graph showing a pulse skipping waveform versus half-bridge voltage in the embodiment.

An actual pulse skipping waveform in a test setup is shown in FIG. 6, where the curve B represents lamp current and C represents voltage. As seen in FIG. 6, advantageously at least one-half cycle of current, and in this example approximately two cycles of current, are skipped at time "A." Nevertheless, the lamp does not extinguish because of the ionization time constant of the fluorescent lamp. The time it takes for the mercury atoms inside the lamp to recombine when the current goes to zero is usually several milliseconds, allowing the lamp to continue to generate light, and allowing the disclosed pulse skipping method be employed to regulate current levels and therefore light output levels.

Figure 5:
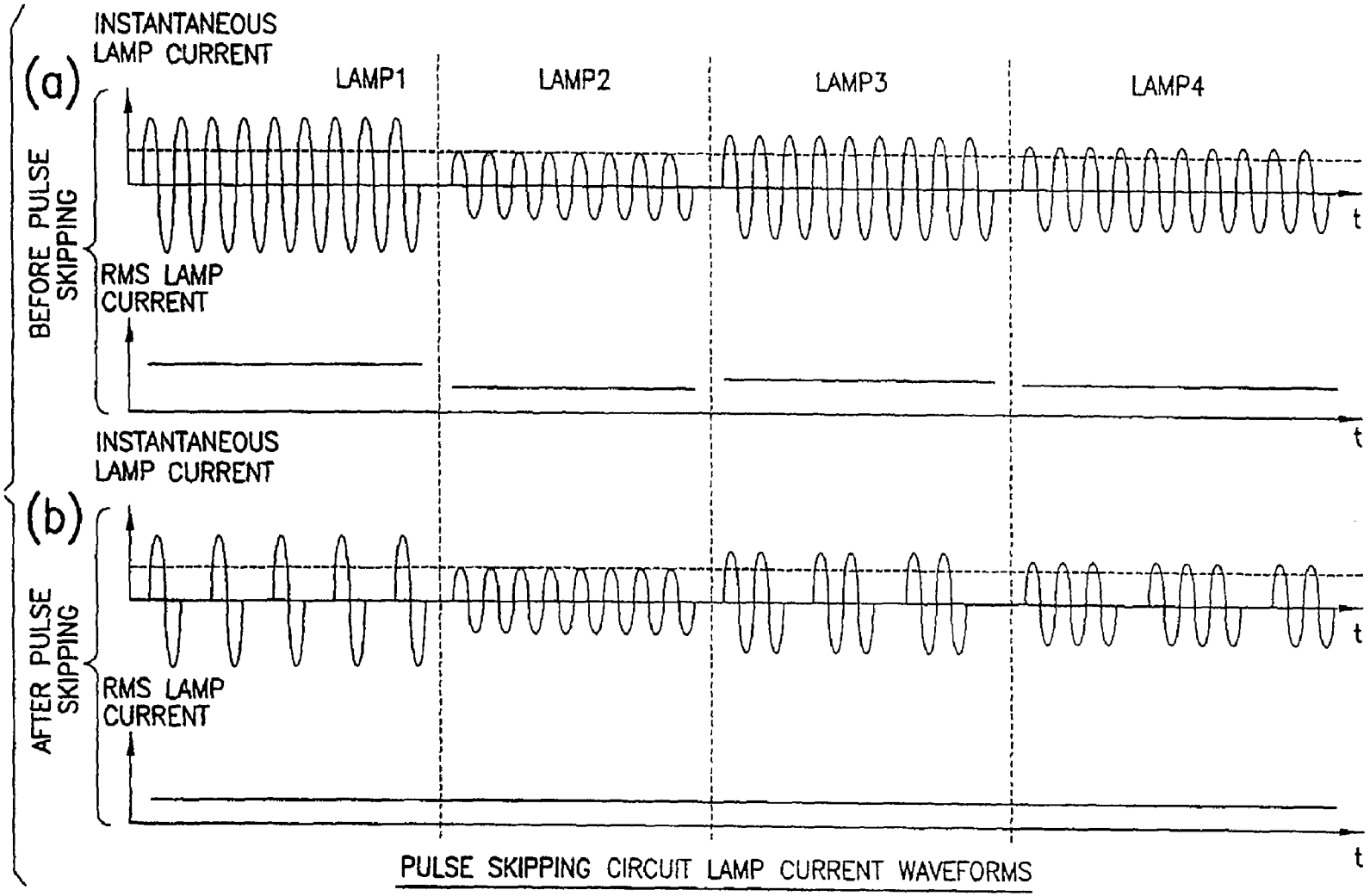
FIG. 5 is a graph showing lamp current waveforms with and without pulse skipping according to the embodiment.

In more detail, the pulse skipping current matching control circuit 200 controls a switch in series with each lamp (S1, S2, S3, etc.) that is opened up to interrupt the current. The switch in series with a given lamp remains open for a given number of cycles, based on a comparison between the RMS current and a reference. The higher the RMS current above the reference, the greater the number of pulses skipped. As seen in FIG. 5(*a*), Lamps 1-4 have different instantaneous current amplitudes resulting in different RMS current and lamps brightness levels. Switches S1, S3 and S4 are opened for every second cycle, every third cycle, and every fourth cycle, respectively, of the lamp driving signal. As a result, as shown in FIG. 5(*b*), the RMS current levels of Lamps 1, 3 and 4 are reduced to match that of Lamp 2. Lamp 2, which has the lowest RMS current, is used in this example as the reference for the other lamp currents.

A fixed minimum reference may alternatively be provided in order to prevent the lamp currents from decreasing below a brightness level that is predetermined to be too low for sufficient backlighting.

A sensing resistor is provided in series with each switch (R1, R2, R3, etc.) for measuring the respective lamp currents.

Figure 1:
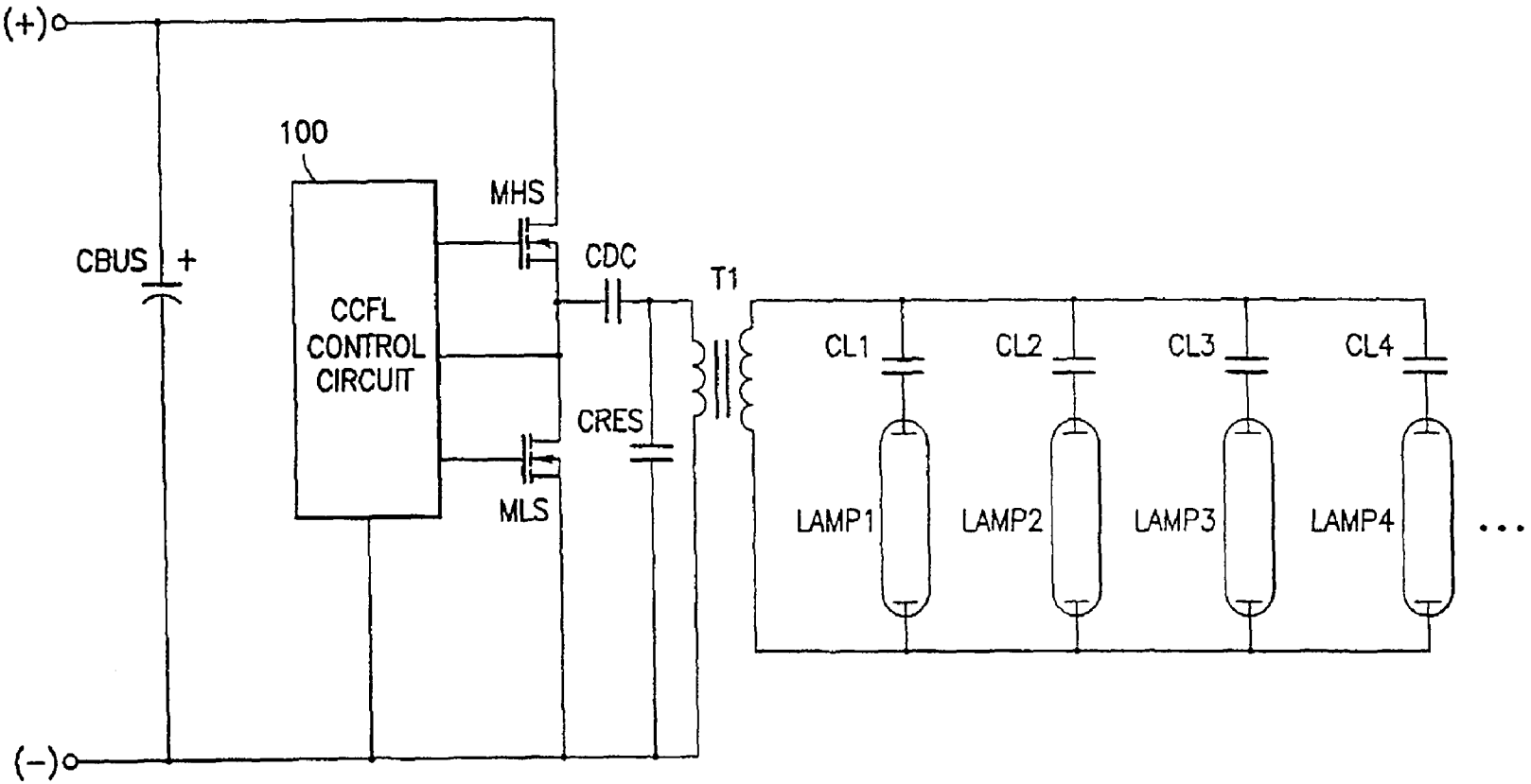
FIG. 1 PRIOR ART
FIG. 1 is a schematic block diagram of a conventional CCFL circuit.
Figure 2:
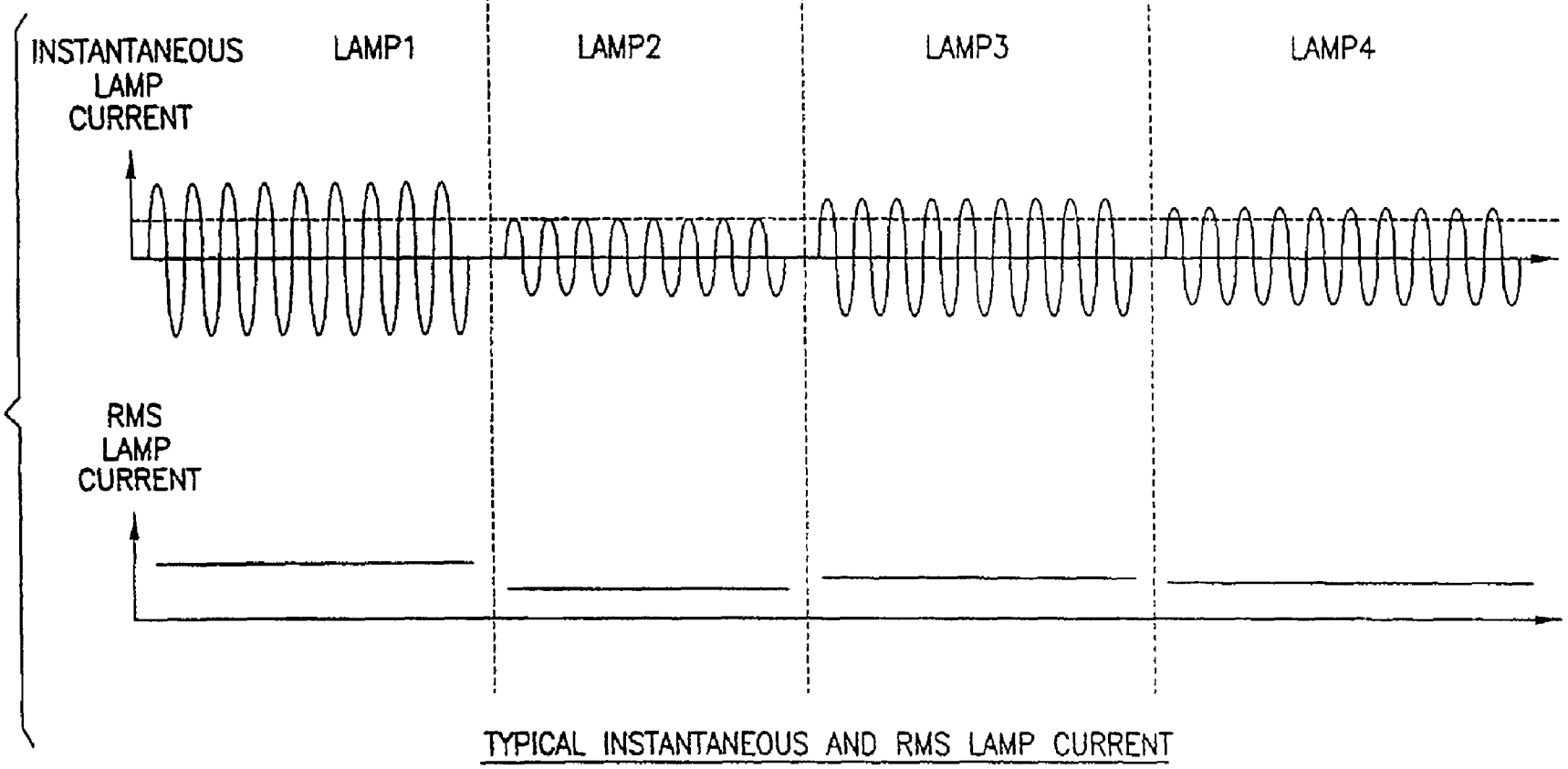
FIG.2 PRIOR ART
FIG. 2 is a graph showing uneven current flow in the lamps of FIG. 1.
Figure 3:
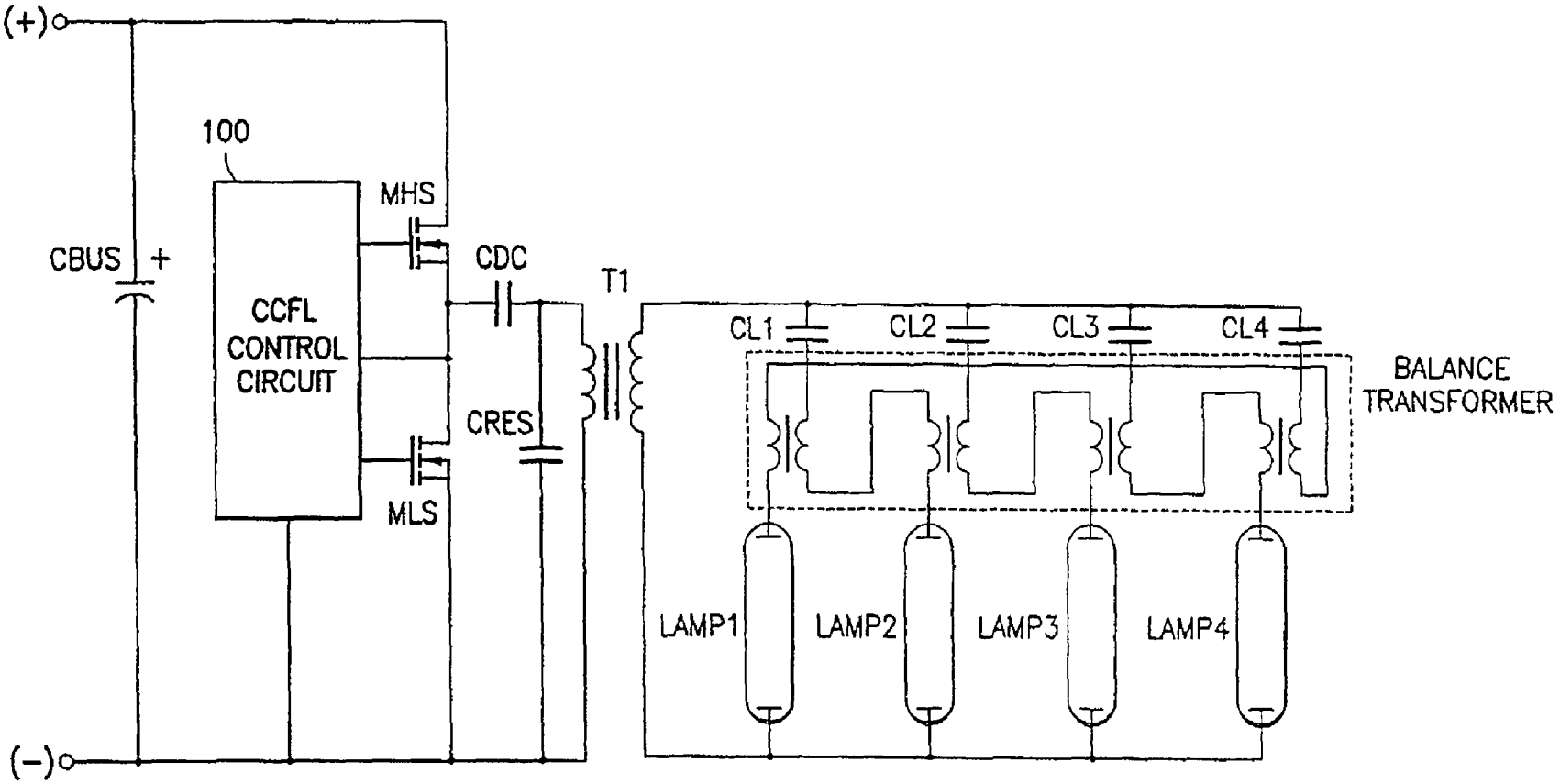
FIG.3 PRIOR ART
FIG. 3 is a schematic block diagram of a CCFL circuit including a balance transformer current matching circuit.
Figure 4:
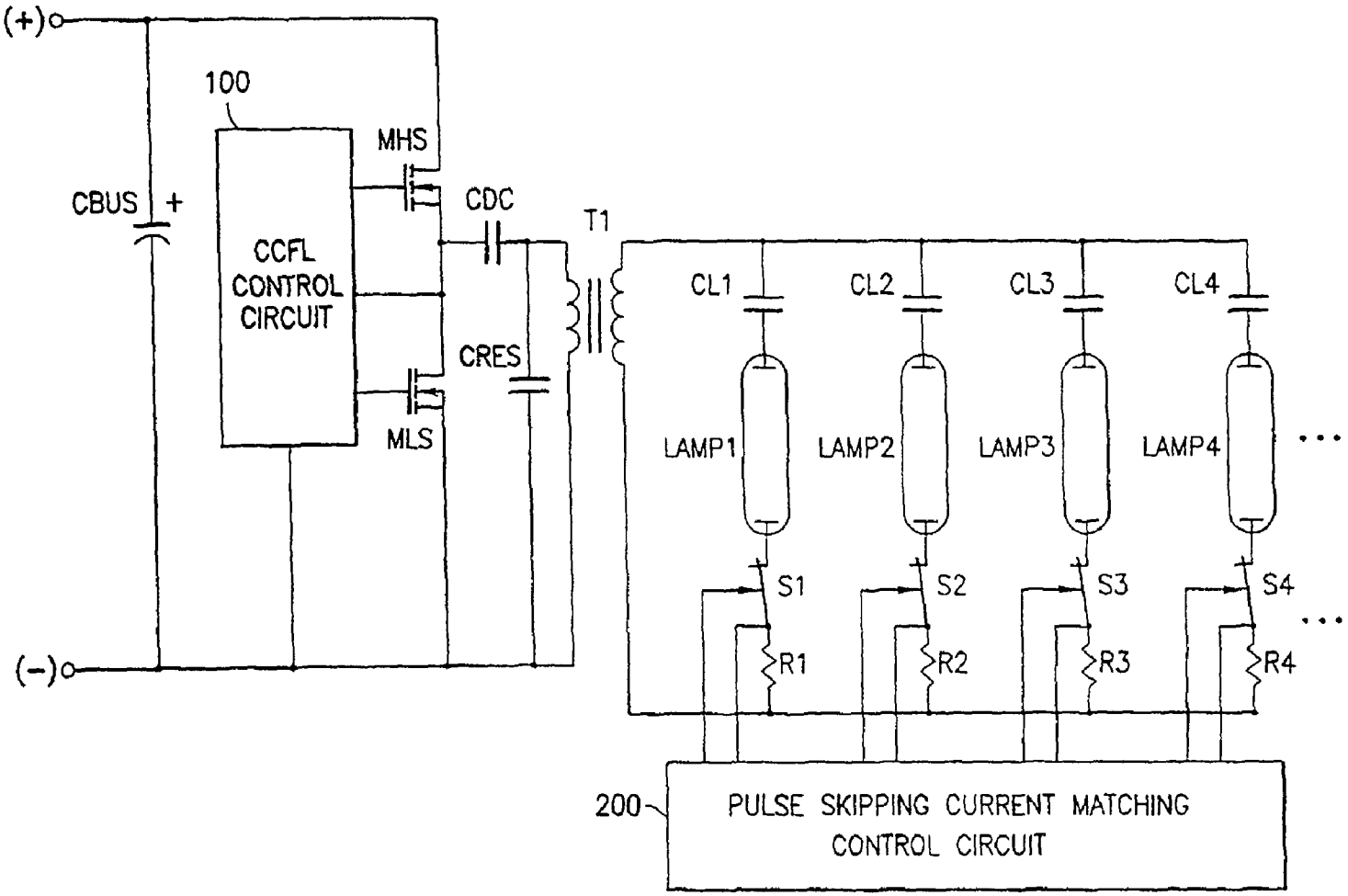
FIG. 4 is a schematic block diagram of a CCFL circuit including a pulse skipping current matching control circuit according to an embodiment of the invention.

With the circuit of FIG. 4, multiple lamps can be controlled to have a matched current (and therefore brightness) level. This circuit eliminates the need for an additional balancing transformer and allows for an unlimited number of lamps to be controlled. The circuit also lends itself to integration into a single IC that may include the switches S1 . . . , the matched sensing resistors R1 . . . , and the control circuit 200. Such an IC can then be placed independently on the secondary side of the main transformer T1 of the CCFL control circuit without requiring any control signals from the primary side.

Figure 7A:
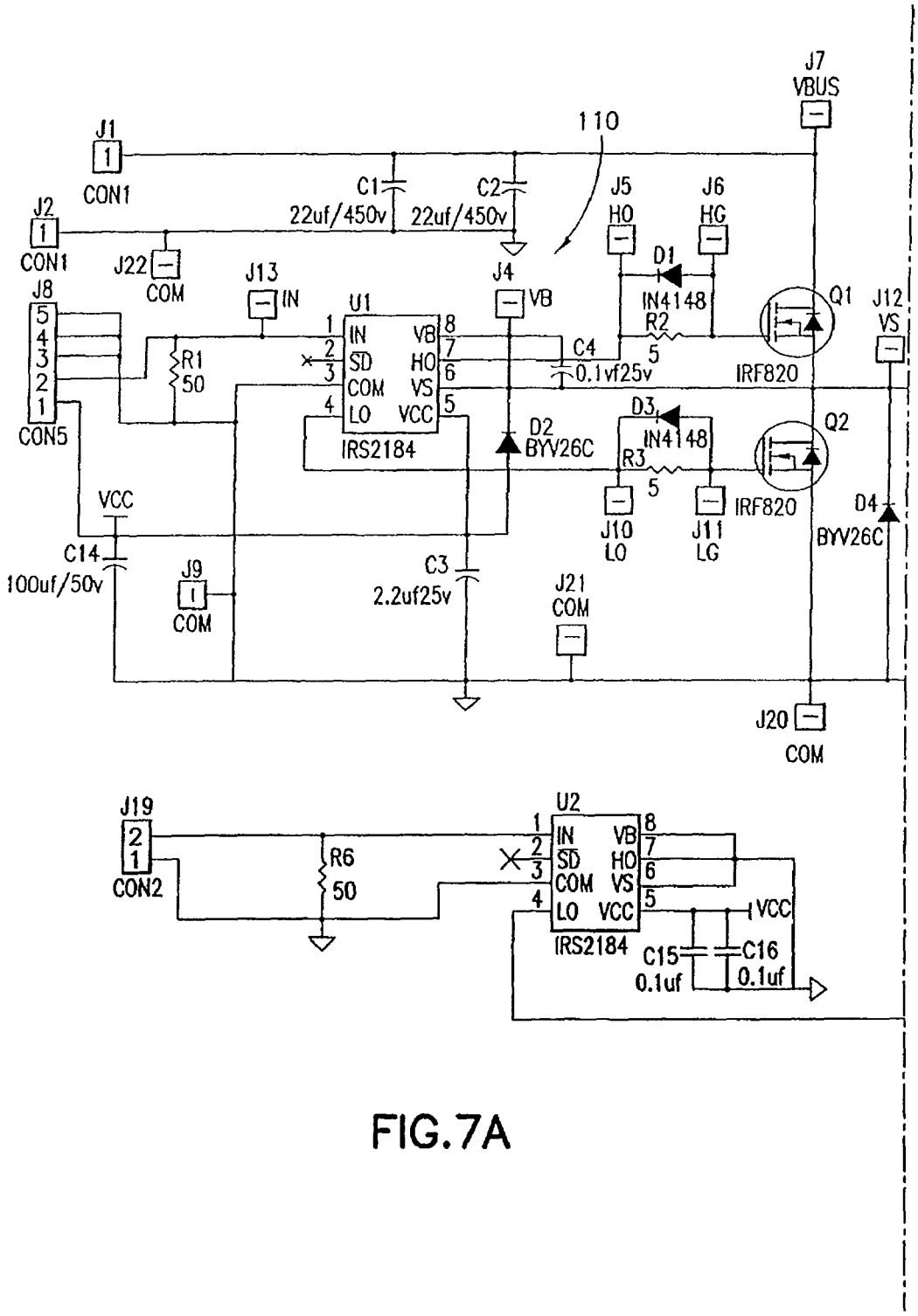
FIG. 7 is a schematic diagram of a CCFL circuit including a pulse skipping current matching control circuit according to another embodiment of the invention.
Figures 7, 7A, 7B:
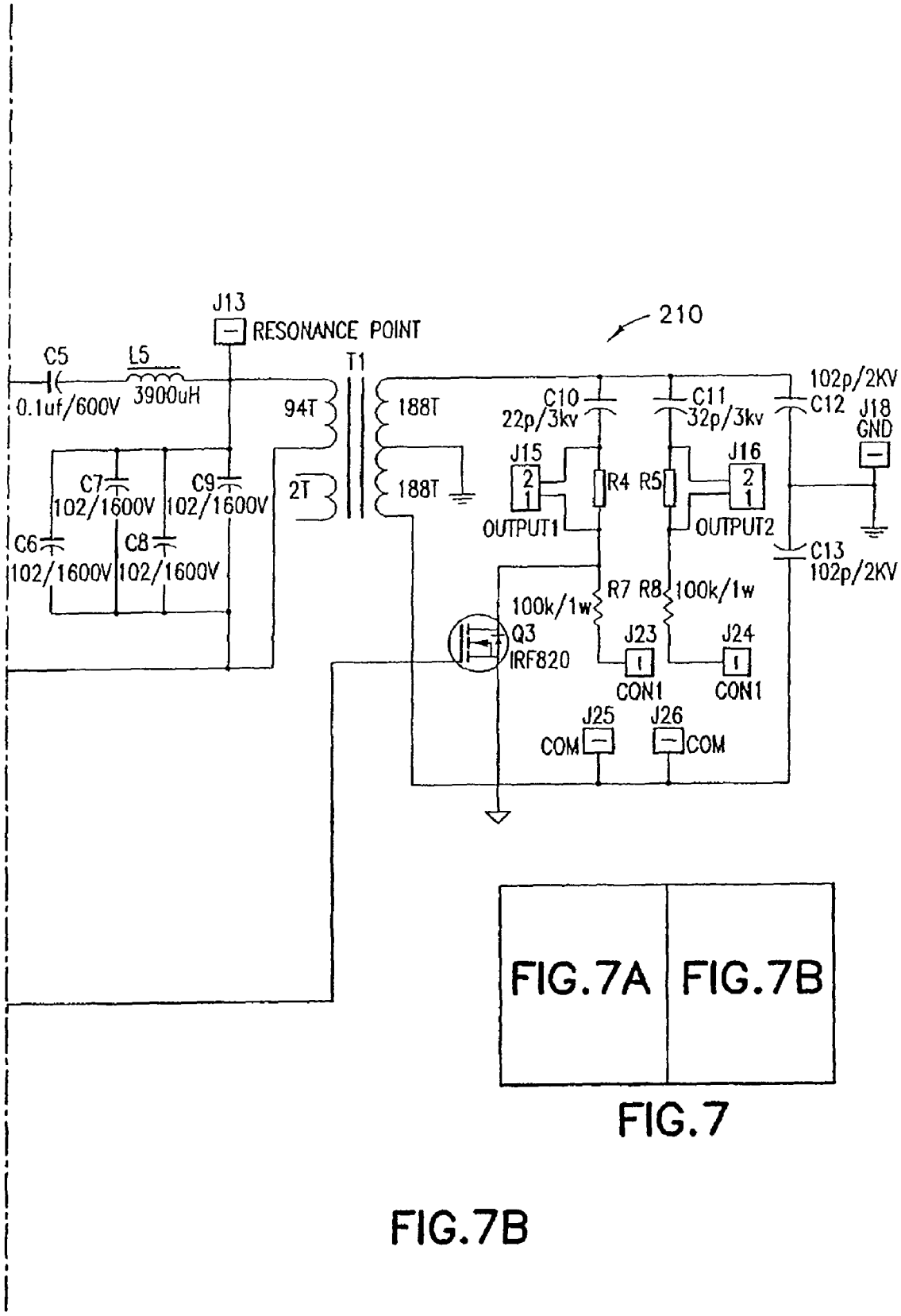

FIG. 7 shows a CCFL driver circuit including a current balancing scheme according to another embodiment of the invention. The proposed current balancing scheme utilizes a resistor inserted intermittently in series with the lamp to modulate the lamp current by reducing it to match another pre-selected lamp that has a lower current.

The circuit has a half bridge driver 110 (U1, Q1, Q2 and related components) followed by a tuned circuit (C5~C9 and L5) to strike the lamp and provide a sinusoidal waveform to the lamp, and a transformer (T1) to isolate the lamp/load from the mains.

A current balancing section 210 has Q3 and U2, the current reducing resistor R7, as well as lamp R4. Lamp R5 acts as a non-modulated lamp used as a reference. In this example, U1 and U2 may be provided by the IRS2184 half-bridge driver available from the International Rectifier Corp. Connectors J23~J26 are used to insert a shunt suitable for measuring the lamp current, such as a low-resistance current sensing resistor. The shunt will normally be inserted between J23 and J25 and/or J24 and J26.

The circuit receives a fixed frequency pulse train from a suitable oscillator through J8 and a synchronized reduced frequency/divided pulse train through J19. This latter pulse train controls U2 to turn Q3 on and off. Q3 is normally on, thereby grounding one end of the lamp and bypassing the resistor R7. When Q3 is off, the resistor R7 is inserted in series with the lamp, causing the lamp current to be reduced. The frequency of the resistor insertion will reduce the RMS value of the lamp current, hence dimming the lamp.

Figure 8:
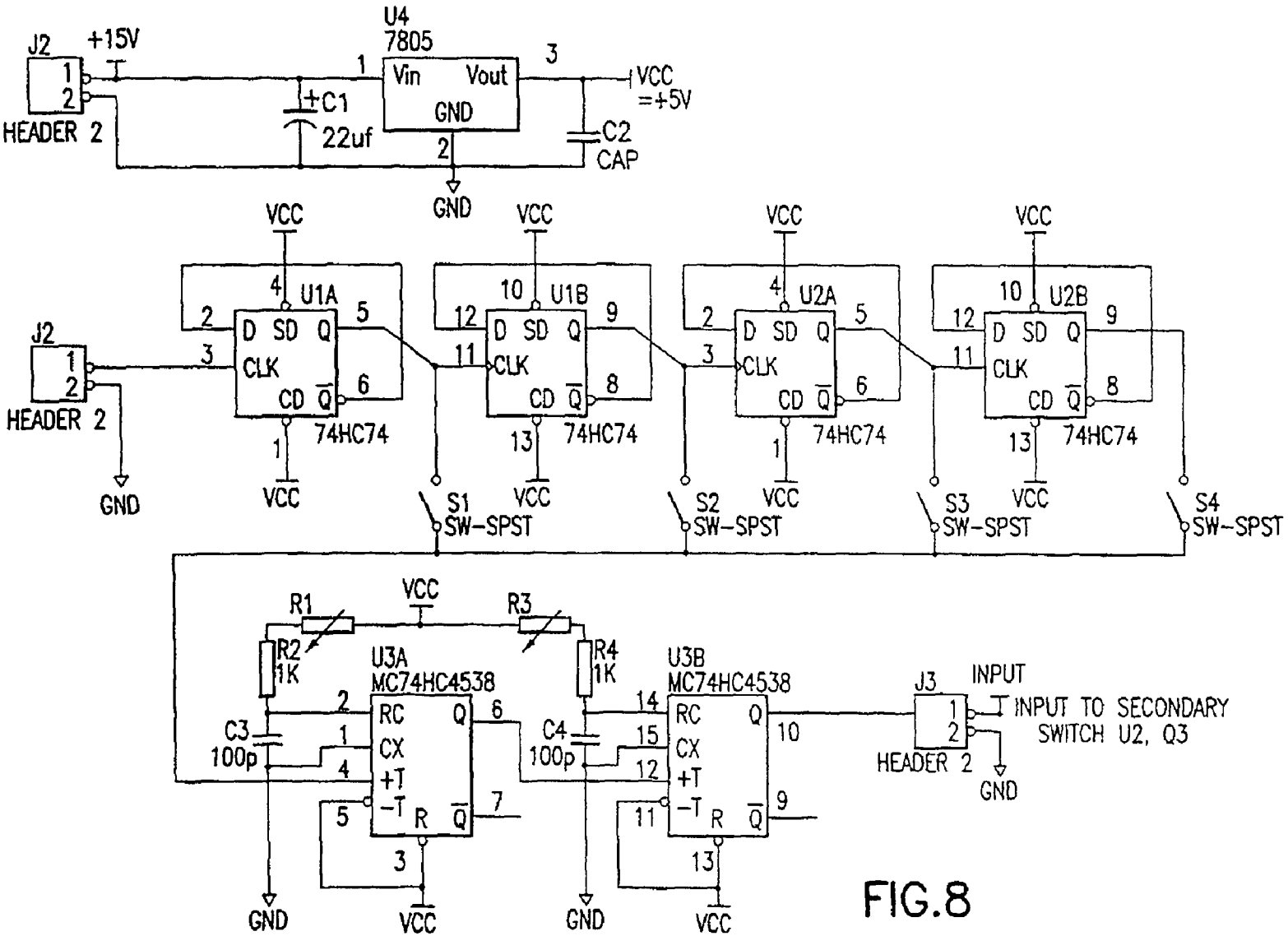
FIG. 8 is a schematic diagram of a function generator for generating control signals.
Figure 9:
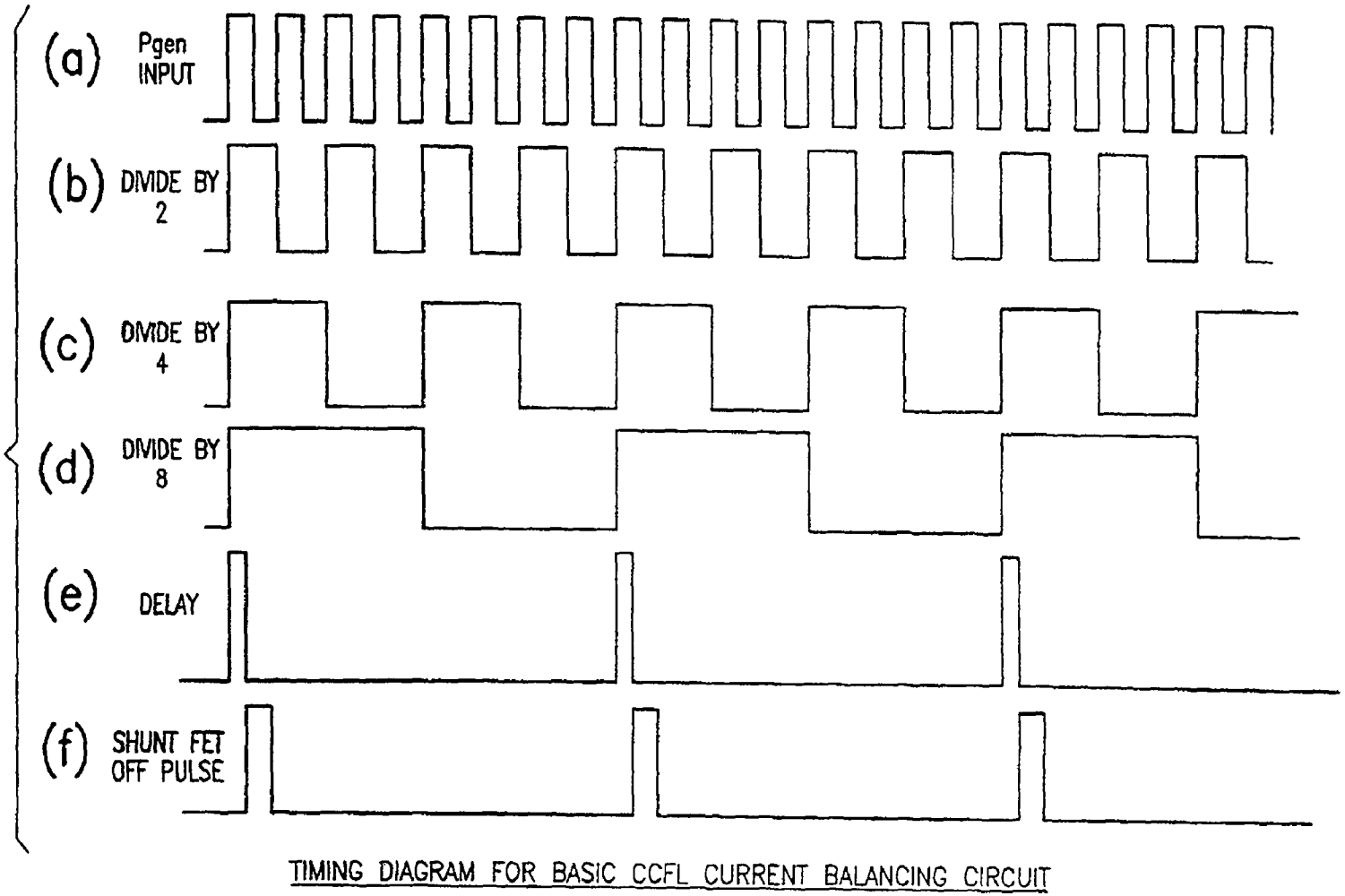
FIG. 9 is a timing diagram showing signals in the circuit of FIG. 8.

FIG. 8 shows an example of a function generator for use with the current balancing circuit of FIG. 7. A timing diagram is shown in FIG. 9. A fixed frequency master pulse train (FIG. 9(*a*)), preferably having the same frequency as that supplied at J8 in FIG. 7, is introduced at J2. A string of D type flip-slops U1A, U1B, U2A, U2B divide the incoming pulse train by a factor of 2, 4, 8 or 16 (FIGS. 9(*b*)-9(*d*)), respectively. One of the frequency-divided pulse trains is selected by closing one of the switches S1, S2, S3 or S4, and the selected pulse train is used to generate a delay pulse and an OFF pulse (via monostables U3A and U3B, respectively). The delay is provided to account for inherent delays in the circuit of FIG. 7 so as to synchronize the on/off function of the resistor with the voltage and current across the lamp. The OFF pulse is supplied to J19 in FIG. 7 for controlling the driver U2 to turn off the FET Q3. The length of the OFF pulse in this embodiment, shown in FIG. 9(*f*), is one-half cycle of the input signal shown in FIG. 9(*a*).

As with the embodiment of FIG. 4, the components U2, Q3 or the components U2, Q3, R7, R8, plus related components, can be included in a single IC, possibly with the circuit of FIG. 8 as well.

As used herein, the term "matching" should be understood to include "substantially" or "approximately" or "subjectively" matching the RMS lamp current so as to improve the brightness uniformity of the lamps. Exact matching of lamp parameters to any specific tolerance is not required for these embodiments of the invention.

Although the present invention has been described in relation to particular embodiments thereof, many other variations and modifications and other uses will become apparent to those skilled in the art. Therefore, the present invention is not limited by the specific disclosure herein.

What is claimed is:

1. A method of matching the brightness of a plurality of lamps driven by an AC drive current, comprising the steps of:

determining a brightness of each of said plurality of lamps, while said plurality of lamps are on, by using a current sensing device;

selecting a first lamp having a lowest brightness from said plurality of lamps; and reducing a brightness of a second lamp to match said lowest brightness of the first lamp by interrupting the AC drive current in said second lamp periodically for a predetermined number of half-cycles of said AC drive current.

2. A method according to claim 1, wherein said reducing step comprises the step of reducing said AC drive current by opening a switch in series with said second lamp.

3. A method according to claim 2, wherein said switch is turned off for said predetermined number of half-cycles of said AC drive current.

4. A method according to claim 1, wherein said reducing step comprises the step of reducing said AC drive current by inserting a resistance in series with said second lamp.

5. A method according to claim 4, wherein one end of said second lamp is connected to ground via a parallel connection of said resistance in parallel with a switching device, said switching device being turned off in said reducing step so that said resistance is thereby connected between said second lamp and ground.

6. A method according to claim 5, wherein said switch is turned off for said predetermined number of half-cycles of said AC drive current.

7. A method according to claim 5, further comprising the step of generating and applying periodic OFF pulses to said switching device.

8. A method according to claim 7, wherein said OFF pulses are spaced apart by said predetermined number of half-cycles of said AC drive current selected for matching the brightness of the first and second lamps.

9. A method according to claim 8, further comprising the step of delaying said OFF pulses by a predetermined delay time corresponding to circuit parameters.

10. A method of controlling the brightness of a lamp driven by an AC drive current, comprising the steps of:

determining a reference brightness of a reference lamp, while said reference lamp is on, by using a current sensing device;

selecting said reference brightness; and reducing a brightness of the lamp in relation to the reference brightness by interrupting said AC drive current in said lamp periodically for a predetermined number of half-cycles of said AC drive current to adjust an RMS value of said AC drive current in said lamp to be substantially equal to an RMS value of a reference current of said reference brightness.

11. A method according to claim 10, wherein said reducing step comprises the step of reducing said AC drive current by opening a switch in series with said lamp.

12. A method according to claim 10, wherein said reducing step comprises the step of reducing said AC drive current by inserting a resistance in series with said lamp.

13. A method according to claim 12, wherein one end of said lamp is connected to ground via a parallel connection of said resistance in parallel with a switching device, said switching device being turned off in said reducing step so that said resistance is thereby connected between said lamp and ground.

14. A circuit for driving a lamp with controllable brightness comprising:

a drive circuit for supplying an AC drive current to said lamp and a reference lamp; and a reducing circuit for determining a current in said lamp and said reference lamp, while said lamp and said reference lamp are on, by using a current sensing device, said reducing circuit interrupting the AC drive current in said lamp periodically for a predetermined number of half-cycles of said AC drive current so as to set an RMS value of said AC drive current in the lamp to match an RMS value of said AC drive current in said reference lamp.

15. A circuit according to claim 14, wherein a brightness of said reference lamp is selected to be a reference brightness.

16. A circuit according to claim 14, wherein said reducing circuit comprises a switch connected in series with said lamp.

17. A circuit according to claim 16, further comprising a control circuit for turning off said switch for said predetermined number of half-cycles of said AC drive current.

18. A circuit according to claim 14, wherein said reducing circuit comprises a resistance connected in series with said lamp.

19. A circuit according to claim 18, wherein one end of said lamp is connected to ground via a parallel connection of said resistance in parallel with a switching device, and further comprising a control circuit for turning off said switching device periodically so that said resistance is thereby connected between said lamp and ground.

20. A circuit according to claim 19, wherein control circuit turns off said switch for said predetermined number of half-cycles of said AC drive current.

21. A circuit according to claim 19, wherein said control circuit generates and applies periodic OFF pulses to said switching device.

22. A circuit according to claim 21, wherein said OFF pulses are spaced apart by said predetermined number of half-cycles of said AC drive current selected for matching the brightness of the lamp to a reference brightness of said reference lamp.

23. A circuit according to claim 22, wherein said control circuit further delays said OFF pulses by a predetermined delay time corresponding to circuit parameters of said drive circuit and said reducing circuit.

24. A circuit according to claim 14, wherein said reducing circuit is comprised in a single integrated circuit.

* * * * *